United States Patent [19]

Schine

[11] Patent Number: 4,684,937

[45] Date of Patent: Aug. 4, 1987

[54] ENHANCED DATA DISPLAY SYSTEM

[76] Inventor: Jonathan M. Schine, 626 S. Hudson, Los Angeles, Calif. 90005

[21] Appl. No.: 686,219

[22] Filed: Dec. 26, 1984

[51] Int. Cl.[4] ..... G09G 1/06

[52] U.S. Cl. ..... 340/728; 340/744; 340/750

[58] Field of Search ..... 340/728, 744, 747, 750, 340/748

[56] References Cited

U.S. PATENT DOCUMENTS

| | | | |
|---|---|---|---|
| 4,359,728 | 11/1982 | Mahoney | 340/728 X |
| 4,400,791 | 8/1983 | Kitado | 340/728 X |
| 4,464,656 | 8/1984 | Nakamura | 340/728 |
| 4,481,509 | 11/1984 | Sasaki et al. | 340/728 |
| 4,516,119 | 5/1985 | Fukata | 340/728 X |
| 4,544,922 | 10/1985 | Watanabe et al. | 340/728 |
| 4,555,191 | 11/1985 | Uojo | 340/728 X |

*Primary Examiner*—Gerald L. Brigance
*Assistant Examiner*—Vincent P. Kovalick
*Attorney, Agent, or Firm*—Freilich, Hornbaker, Rosen & Fernandez

[57] ABSTRACT

Display of alphanumeric characters and other symbols generated in a dot-matrix form on a CRT is enhanced by modulating the CRT beam sinusoidally at the dot matrix clock rate to produce one full cycle of modulation for each dot space with a phase to display a dot on a slope between modulation maxima of opposite polarity. The phase and amplitude of the modulation is selected to place the q dots displayed in a dot space between the modulation maximum of one polarity and a maximum of opposite polarity for each dot space of an $M \times N$ matrix, with a depth of modulation of $\pm\frac{1}{4}$ raster scan spacing of the CRT.

4 Claims, 7 Drawing Figures

ENHANCED DATA DISPLAY SYSTEM

BACKGROUND OF THE INVENTION

This invention relates to a display terminal for a digital data processing system, and more particularly to enhancement of alphanumeric and other data symbols displayed on a cathode ray tube (CRT) operated in a raster scan mode, as disclosed in U.S. Pat. No. 3,345,458.

In the raster scan mode, the electron beam is swept across the screen in parallel lines until the entire surface (field) of the screen has been swept. The beam is controlled to brighten dots at selected points that define a character in a line of data.

Typically, a frame is divided into 80 columns and 24 rows. Each column provides a character space, and each row provides a line of characters. The character space defined by a column and row count is further subdivided into a matrix of dot positions, typically $8\times11$, where each of seven horizontal dot positions in each of ten scan lines may be selectively brightened to make up a character. The useful dot matrix within a character space is thus $7\times10$, leaving a clear scan line to separate lines of characters, and a clear column at the end (or beginning) of each character to separate characters in a line. Consequently, the entire field displayed is divided into an array of $560\times264$ adjacent dot spaces, even though some spaces are not used, to provide spaces between characters and lines of characters, and within a $7\times10$ matrix, only those actually needed to form a character are used while displaying data.

For data display purposes, a clock generator operating in the megahertz range is divided down to obtain a 60 Hz vertical (V) sync rate, and down further to get horizontal (H) sync rates, thereby producing field display at the rate of 60 per second. This chain of dividers will not only synchronize the data display with the horizontal and vertical scan of noninterlaced fields, but provide the addressing information necessary to read out into a shift register trains of binary digits, where each bit 1 will cause the beam to brighten a dot as a line is scanned. When the entire raster of scans for a line of characters have been scanned, and all 24 lines of data have been displayed, the data stored in a RAM will have been displayed in $80\times24$ character spaces.

For each character space, the shift register is loaded with a new train of binary digits as a line of data is displayed. These binary digits define the dots to be displayed and, as the last of the previous train is shifted out into a video mixer that combines sync and blanking with the binary digits into a composite signal for display, the next set of binary digits is loaded into the shift register. In the CRT display unit, a horizontal (H) and vertical (V) drive generator responds to the horizontal and vertical sync pulses to produce the horizontal and vertical drive signals applied to deflection coils, while the binary digits from the shift register, and the blanking signals, are applied to the cathode of the CRT. In that way, the beam is brightened for dots defined by 1 bits out of the shift register, and blanked at all other times while 0 bits are shifted out and while the blanking signals for line and field retrace are present.

To form a line of characters the clock frequency divider is used to address a random access memory (RAM) for each line of 80 characters, one character at a time in sequence. Each output character code, together with the output of a counter that counts the lines of characters, addresses a character generator implemented with a read only memory (ROM) to produce in sequence the corresponding lines of binary digits that define the characters in the row addressed. A shift register receives the binary digits in parallel for one character at a time in sequence, and converts them into a continuous serial train. After the procedure has been repeated ten times for one line of 80 characters, the address to the RAM is advanced to the next line of 80 characters. In that manner the output of the RAM addresses the character generator to convert the character code out of the ROM into the binary digits that define the positions of dots for the characters.

The number of raster scans per field is limited, typically to 280. For a block of $80\times24$ characters, with an $8\times11$ dot matrix for each character, for example, there must be $11\times24=264$ raster scans used. The rest of the time (26 raster scans) is not available for data display, and is instead partly used for field retrace, although sometimes 11 raster scans are used for display of operating information, such as terminal status, host messages, set-up mode or function key legends.

Due to the velocity of the beam across the CRT screen, each dot is in actuality displayed as an ellipse with its major axis horizontal. Consequently, adjacent horizontally spaced dots run together, particularly when the width of the dot space is reduced in order to display 80 characters in a line, while adjacent vertically spaced dots do not. The result is that the characters appear to be made up of discrete dots in vertical and diagonal portions of a character, and solid bars in horizontal portions. This deficiency in the vertical and diagonal directions provides rather low definition of characters displayed.

A simple way to increase vertical resolution would be to use interlaced fields so that the odd field is displaced a half raster scan space, but since the data being displayed is constant until changed, the characters will appear to flicker. That is quite disturbing to the viewer. It is therefore preferable to use noninterlaced fields to display data refreshed 60 times per second. The problem is to enhance the data display within those constraints.

SUMMARY OF THE INVENTION

In accordance with the present invention, data display is enhanced by vertical modulation of the horizontal raster scans at a frequency that will produce one complete cycle per Mxn dot matrix space. For optimum results, the depth of modulation should be at least $\pm\frac{1}{4}$ the spacing of the raster scans, depending on beam width, dot duration, and line spacing. Then, as an M-bit code for a character to be displayed is read out of a shift register, clocked at the frequency required for a line of data to be displayed in a raster scan as a dot for every bit 1 in the M-bit code, each dot is displayed during a portion of one cycle of modulation in the dot space.

The phase of the modulation is adjusted relative to the shift register clock so that a dot is displayed while the beam is being deflected between negative and positive maxima, on either the positive or the negative slope. In that manner a fixed Mxn dot matrix space is used for each character with the elliptical dots displaced with their major axis at an angle with respect to the horizontal. The space between dots in a direction having a vertical vector component is thus reduced, and in the special case of the direction being about half way between the horizontal and the vertical, such as at 45°, a nearly perfect continuous line will appear. This improvement is achieved without significantly degrading the horizontal resolution. This is because the dot spacing is not as great in the horizontal direction as in the vertical. i.e., the dot spaces are usually rectangles having a width that is less than the height. This is particularly true of the state-of-the-art 80 column display, as opposed to a 40 column display. The more noticeable effect is a thickening of horizontal portions of the characters displayed with some lessening of thickness in the portions having a vector component in the vertical direction, and near perfect portions having a slope of about +45° if the dots are displayed on the positive slope of the modulation, or a slope of about −45° if the dots are displayed on the negative slope of the modulation, but not both; in one there will still be some space between dots discernable, but in the more usual dot-matrix, alphanumeric characters, only a small percentage of the character lines are in the disadvantageous direction. Even in upper case letters less than about 20% have less than about 20% of their lines at the disadvantageous direction, so the net effect is a significant improvement in character resolution in about 96% of an 80×24 character display.

The novel features of the invention are set forth with particularity in the appended claims. The invention will best be understood from the following description when read in conjuction with the drawings.

DESCRIPTION OF PREFERRED EMBODIMENTS

Figure 1:
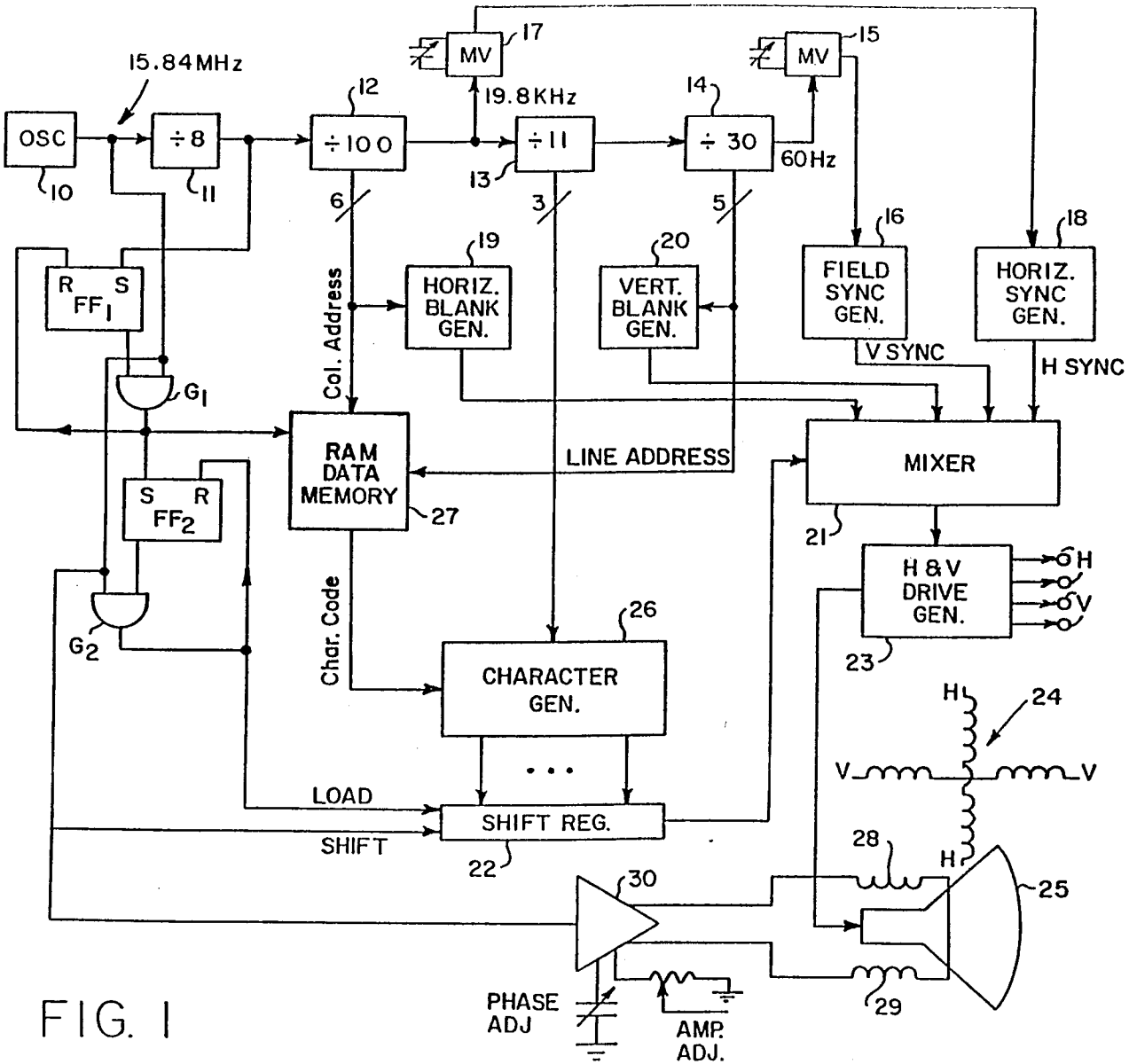
FIG. 1 is a block diagram of one embodiment of the present invention.

Referring now to FIG. 1, the portion of a data display system into which the present invention is incorporated will first be described. Then the present invention incorporated therein will be described in detail. For simplicity, a conventional display of 80 columns and 24 rows of data will be used in the example of a preferred embodiment.

A clock generator 10 operating at 15.84 MHz is connected to a frequency dividing chain comprised of binary counters 11 through 14. The output of the last counter 14 at 60 Hz is connected by a delay multivibrator 15 to a vertical (V) sync generator 16 for field synchronization. The output of the counter 12 at 19.8 kHz is connected by a delay multivibrator 17 to a horizontal (H) sync generator 18 for synchronizing the display of 330 rasters at the rate of 60 fields per second. The multivibrators are included to provide variable delay that can be used to adjust the timing of the H and V sync pulses.

The H and V sync pulses are combined with raster and field blanking signals derived from blanking generators 19 and 20 which decode the outputs of counters 12 and 14 to produce horizontal and vertical blanking signals at all points outside the 80×24 character display, as determined by the column address from the counter 12 and the line address from the counter 14. The H and V pulses are combined in a mixer 21 which adds dot display signals from a shift register 22 to produce a composite character display signal. This composite signal is applied to a conventional horizontal and vertical (H and V) drive generator 23 which drives the H and V deflection coils in a yoke 24 of a cathode ray tube 25, and passes on the dot display signals to the cathode of the cathode ray tube.

The dot display signals from the shift register represent a continuous train of dot-matrix coded binary digits in groups of 8, one group for each of 40 characters of a line of data. To produce the entire line of characters, each in an 8×11 dot matrix, a set of 11 trains, each of 640 bits, are read into the shift register 22 from a character generator 26 in groups of 8 bits, one 8-bit character code for each of 80 characters repeated eleven times for each of the eleven rows of the 80 characters. In actual practice, the ROM stores only the bits of the 7×10 part of the dot matrix space. The eighth bit not read from the ROM is effectively inserted into the train at the output of the shift register 22, and the eleventh 8-bit code for each character may be effectively implemented at the line address input of the character generator which decodes the eleventh line address, and in response to that, force the output of the ROM to be zero regardless of the character code being received.

The divider 12 is used to address a RAM data memory 27 for the 80 characters in a line. Note that there are 100 possible character addresses generated by the divider 12, but only character addresses 10 through 90 are decoded, thereby effectively providing a blank space of 10 characters on each side of the data display block which is forced to be blank by the horizontal blanking generator 19.

The RAM data memory is advanced from line to line by a line address from the divider 14. Here again there are 30 line addresses possible, but the RAM memory only accepts addresses for lines 2 through 25 thereby effectively leaving one blank line above and five blank lines below the 80×24 block of data which is forced to be blank by the vertical blanking generator 20. A 25th line of operating information may be displayed in one of the remaining five, such as the second line, leaving the remaining three lines for field retrace.

The output of the divider 11 sets a flip-flop $FF_1$ which enables an AND gate $G_1$ to transmit the next clock pulse from the clock generator 10. That transmitted pulse not only synchronizes the operation of the RAM data memory in reading out a character code as an address for the character generator, but also resets the flip-flop $FF_1$. The output of the AND gate $G_1$ sets a flip-flop $FF_2$ to enable an AND gate $G_2$. The next clock pulse from the clock generator 10 is then passed so as to not only load the shift register 22 from the character generator output but also reset the flip-flop $FF_2$.

Each character code read out of the RAM data memory may be according to any code for which the character generator is designed, such as ASCII. That code is used to address the character generator 26 which has stored the dot code matrix for each character. Assuming an 8×10 matrix, the character generator 26 addresses each of the ten consecutive rows of the 80 matrices specified in sequence by the character code from the RAM data memory 27. As the RAM data memory is advanced across forty characters for ten consecutive times, the divider 14 holds the same line address, but each time the output of the divider 12 increments the divider 13, the output of the divider 13 is advanced by one to advance the character generator 26 to the next row of bits that define all Mxn matrices of the 80 characters in the line of data displayed.

The synchronized load of a 7-bit code may take place during the time the nonexistent eighth bit is read out of the shift register 22. If this is the last bit of the character generator code, left blank for spacing from the next character generator code, left blank for spacing from the next character generator code, the shift pulse is effectively shifting out a bit 0 at the time the next 7-bit code is loaded into the shift register. This is accomplished in the shift register which has 7 stages to store a 7-bit code, and, after shifting out 7 bits, the load signal occurs overriding the shift control and forcing the output of the shift register to zero. That is done by an inhibit gate on the shift input that receives the load signal at its inhibit input, and an output gate normally enabled to pass the bits shifted out except during the presence of a load signal. In that manner, the eigth bit not read from the ROM is effectively inserted as a bit 0 in the 8-bit train at the output of the shift register 22.

Figure 2A:
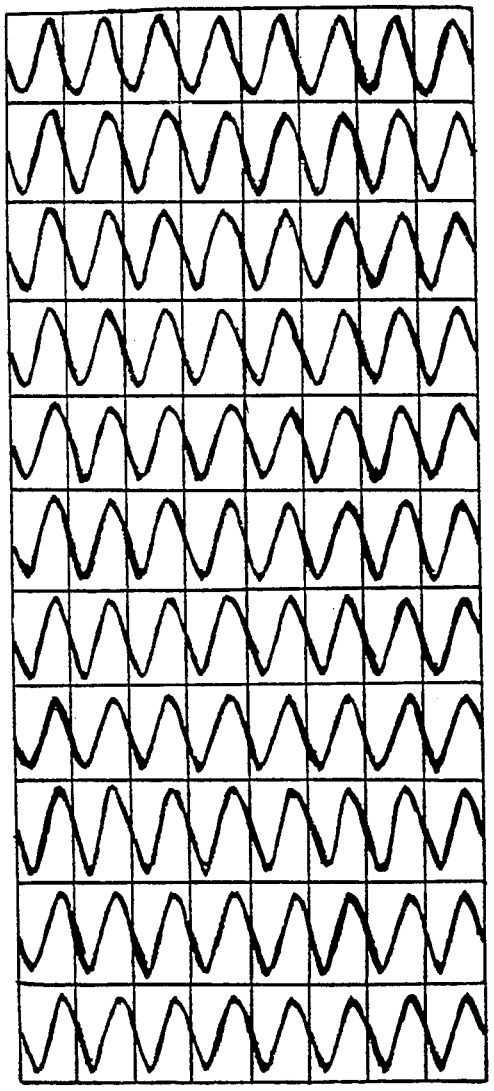
FIG. 2*a* illustrates the modulated raster scan of one 8×10 character space and FIG. 2*b* illustrates one dot space with a dot display superimposed on the one cycle of sinusoidal modulation in the scan of the dot space.
Figure 2B:
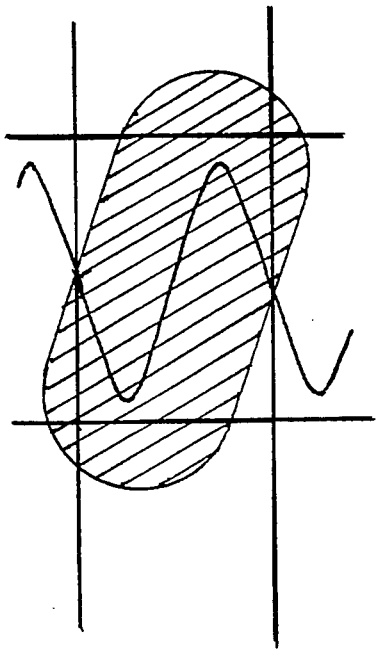

The foregoing arrangement is common to virtually all data display terminals that have been devised in accordance with the teachings of the aforesaid U.S. Pat. No. 3,345,458, with only minor variations in implementation. The present invention departs from the foregoing by using the output of the frequency divider 10 (the shift pulse train) to drive auxiliary vertical deflection coils 28 and 29 via an amplifier 30 having phase and amplitude control so that for each character dot space of an 8×11 matrix, the CRT electron beam is modulated through one cycle, as shown in FIG. 2*a*. The phase of modulation is adjusted relative to the one dot per dot space to place the center of the dot on the positive, or negative, slope of the deflection, as shown in FIG. 2*b*. The depth of modulation is adjusted for the desired slope with respect to the horizontal, such as $\pm\frac{1}{4}$ raster scan spacing, i.e., $\pm\frac{1}{4}$ row spacing of a dot matrix, for a slope of ±45°. In practice the points are displayed with dots having a diameter at least a quarter of a row spacing, and preferably between a half and a full row spacing.

Figure 3A:
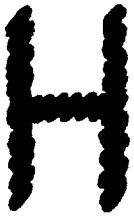
FIG. 3*a* illustrates the arrangement of displayed dots for the letter H in the modulated raster scan space for one character.

By displaying the dots on the positive or negative slope of the sinusoidally modulated raster scan, the tendency for the dots to be drawn out in a horizontal direction due to bandwidth limitation of the cathode ray tube is converted to a drawing out of the dots at an angle, such as about ±45°. This stretching out is more pronounced because the electron beam is moving at a faster speed than if the scan were a straight horizontal line. So instead of the dots being elongated horizontally, the dots are elongated more at an angle to provide more coverage between dots in a direction having a vertical vector component, as shown in FIG. 3*a* for the letter H. This reduces the tendency of horizontally adjacent dots to run together, but not enough to produce a perceptible space between them, and significantly increases the vertical dimension of the dots, for enhanced vertical and diagonal continuity of the charcter displayed.

Figure 3B:
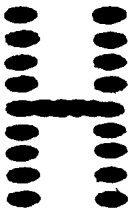
FIG. 3*b* illustrates for comparison the arrangement of dots for the same letter according to the prior art.

The improvement of this continuity over the prior art may be best appreciated by comprison with FIG. 3*b* which illustrates a conventional 8×11 dot matrix for the same character. The present invention is most effective in enhancing display where the character lines are diagonal with the same slope as the elongated dot, such as in the letter K shown in FIG. 4*a*, but it will be appreciated that characters having only horizontal and vertical lines are improved, such as the letter H shown in FIG. 3*a*. The horizontal line becomes wider, as measured in the vertical direction, and slightly more uneven along the edges, but otherwise as solid as before. The vertical lines also become wider, and the space between dots is closed to present a solid line. Any unevenness introduced in the horizontal portions of the characters is more than offset by the overall improvement in the appearance of the characters.

Figure 4A:
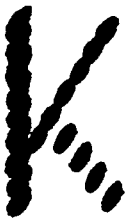
FIG. 4*a* illustrates the arrangement of dots for the letter K in the modulated raster scan space for one character.
Figure 4B:
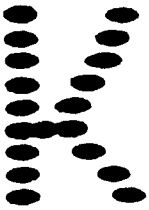
FIG. 4*b* illustrates, for comparison, the arrangement of dots for the same letter according to the prior art.

When a line in a character has a slope of a sign opposite the slope along which the dots are elongated, as for the letter K shown in FIG. 4*a*, the result is a slightly wider line for that portion, but space between dots remains, so that, except for making that portion wider (thicker), its resolution is not significantly increased. Fortunately, only about 20% of the characters will have any portions of significant length with such a negative slope (or positive slope if the dot display is adjusted to be on the negative slope of the sinusoidal modulation by proper shift of the modulation phase), and of those the unimproved portion constitutes less than about 20% of the character. For the letter K in FIG. 3*a*, the unimproved portion is about 21.05% of the total character. Consequently, the enhancement of the 80×24 character display is over $100-(0.20\times0.20)=96\%$ of the total display.

Although particular embodiments of the invention have been described and illustrated herein, it is recognized that modifications and variations may readily occur to those skilled in the art. Consequently, it is intended that the claims be interpreted to cover such modifications and variations.

What is claimed is:

1. A method of enhancing the display of alphanumeric and other characters, including symbols of conventional and arbitrary form, on a cathode ray tube, wherein each character and symbol is formed by dots in a dot matrix of Mxn dot spaces utilizing in a character generator a matrix of Mxn binary digits for each character to be displayed with one binary digit for each dot space of the Mxn dot matrix, where M is the number of horizontal dot spaces in a row, and n is the number of rows of dot spaces in a matrix, and vertically modulating the cathode ray tube beam in a cyclic manner as it scans rasters for display of rows of dots in character spaces with one complete cycle per dot space and a phase of modulation that will place each dot within a dot space on a slope of the scan beam.

2. A method as defined in claim 1 wherein the amplitude of modulation is selected to be at least about $\pm\frac{1}{4}$ the raster scan spacing of said cathode ray tube display system.

3. In a cathode ray tube display system for generating dot-matrix patterns for display of alphanumeric characters and other symbols of conventional and arbitrary form, each character pattern being displayed in a matrix consisting of Mxn dot spaces, said system having a character generator for storing binary digits defining dots in said Mxn dot matrix for each character to be displayed, wherein M binary digits defining a row of dots of each character in a line of data are read for display in series as said cathode ray tube beam scans rasters in sequence, an improvement comprising means for reading out said M binary digits in series for each character during a raster scan covering characters in a line of data for display, said M binary digits being read in synchronism with the raster scan of M dot spaces for each character space in sequence, thereby reading out one binary digit for each dot space, and means for cyclically modulating the vertical deflection of said beam as it raster scans horizontally with a frequency of modulation selected to produce a single cycle in each dot space and with a phase of modulation to display said dots on slopes of the modulated scan beam, each dot within a dot space.

4. The improvement of a data display system a defined in claim 3 wherein the amplitude of modulation is selected to be at least about $\pm\frac{1}{4}$ the raster scan spacing of said cathode ray tube display system.

* * * * *